United States Patent [19]

Lieberman

[11] Patent Number: 4,539,631

[45] Date of Patent: Sep. 3, 1985

[54] LAMP SHADE AND METHOD

[76] Inventor: Gilbert R. Lieberman, 161 Harland, Hampstead, Quebec, Canada

[21] Appl. No.: 627,101

[22] Filed: Jul. 2, 1984

[30] Foreign Application Priority Data

Mar. 8, 1984 [CA] Canada ..... 449153

[51] Int. Cl.[3] ..... F21V 11/00

[52] U.S. Cl. ..... 362/351; 362/355; 362/356; 362/357; 362/358; 362/361; 362/444; 362/452; 362/806

[58] Field of Search ..... 362/351, 355, 356, 357, 362/358, 361, 444, 452, 806

[56] References Cited

U.S. PATENT DOCUMENTS 4,410,932 10/1983 Oster ..... 362/355

*Primary Examiner*—Stephen J. Lechert, Jr.

*Attorney, Agent, or Firm*—Browdy and Neimark

[57] ABSTRACT

A lamp shade comprising a hollow seamless shell or foundation molded from thermoplastic material and to which a lamp spider is secured for supporting the shade with respect to a light bulb or lamp fixture. An inwardly projecting collar is molded integrally with the shell around an opening in the shell and holes are provided in the collar to receive the ends of arms of a lamp spider which are secured therein by fasteners. A method of covering a shade wherein yarn or thread is helically wound around the shade is also disclosed.

11 Claims, 7 Drawing Figures

LAMP SHADE AND METHOD

The present invention relates to a lamp shade and particularly to a hollow seamless shell or foundation for a lamp shade which is strong and durable yet economical in manufacture and of precise shape and to which fabric or other covering material may be applied to provide shades of various colors and appearance.

The shell or foundation which itself may be used as a lamp shade is formed in unitary self-supporting shape from thermoplastic materials by injection molding techniques and the formed shell is then fitted with means preferably of metal or wire for supporting the shell in relation to a light bulb or lamp fixture. These support means may be in the form of lamp spiders and similar known support structures for shades of larger size or bulb clips or clamps for shades of smaller size, but in all cases, the support means are secured to the shell at points interior of the shell so that the outer surface of the shell is smooth and uninterrupted. The present invention achieves the advantages of this feature by forming an inwardly extending integrally molded collar or skirt around an opening in the shell and to which the support means are secured.

The present invention also relates to a method of fabricating these new shades and shells therefor, and also to lamp shades having a novel decorative covering consisting of wound yarn, strand, thread or like filamentary material provided thereon.

DISCUSSION OF PRIOR CONSTRUCTION

One form of shade presently in use consists of upper and lower wire rings around which a blank of cardboard or similar material is wrapped with the ends of the blank being joined together in a vertical seam by adhesive or staples, with the upper and lower edges of the blank being secured to their respective rings by tape bindings which are manually or machine applied. In such constructions, the exterior surface of the blank may be pre-finished to form the final outer surface of the shade or the blank may be wrapped or covered with fabric or the like for enhanced appearance. In other constructions, upper and lower metal rings are joined by vertical wire members to form a frame to which covering material is sewn or wrapped around.

In these known constructions, the wire components and seam cause the formation of shadows when the enclosed light bulb is illuminated which detract from the overall appearance of the shade and which are avoided by the present invention. Moreover, these known shades are susceptible to damage during transport, handling and display and once the wire framing is warped or bent or the cardboard covering creased or otherwise damaged, the shades must be discarded or if repairable, sold only as 'seconds'.

Additionally, and whether the tape binding is applied by machine or by skilled and practised individuals, the tape is often not applied in uniform fashion, and this along with irregularities in the wire framing and the positioning of the cover blank often results in a shade construction having irregular upper and lower edges.

Due to the nature of these known shades and their susceptibility to damage, care must be taken in packaging for shipment to avoid damage. These known shades are usually packaged in semi-nested arrangement for shipment and are separated by spacers to prevent contact of the lower metal ring and vertical wire members of an upper shade with the outer surface of a lower shade which is the primary cause of damage during shipment. This method of packaging increases packaging costs and in view of the need to provide spacers the number of shades which can be packaged in a shipping container of given size is reduced.

THE PRESENT INVENTION

The present invention avoids the disadvantages of these prior art arrangements by providing a molded shell of thermoplastic material having a smooth and uninterrupted outer surface of desired shape and which is precise and uniform, and which is economical in construction, strong and durable, and which as a result of unique method of securing shade support means thereto, avoids the formation of shadows providing uniform diffusion of light therethrough.

In a preferred embodiment of the invention, the upper edge of the shell is integrally formed with an inwardly extending skirt or collar the lower portion of which is inwardly spaced from the exterior portion of the shell and it is to this interior collar that a lamp shade support is secured.

As the shell support is not secured to or in contact with the exterior surface of the shell uninterrupted diffusion of light over the outer surface of the shell is provided and shadow marks or lines commonly present in known shades are avoided. Moreover, as the present shell is molded in one-piece, the seam found in common shades is avoided thus eliminating the usual inconvenience of having to turn a shade to hide the seam from view.

As the shells of the invention are molded in precision molds they are exact and precise in form and symmetry and are free of the imperfections and irregularities usually present in known primarily hand-made shades. Additionally, the present shells which are molded from thermoplastic material such as high impact styrene and the like are strong and durable and are not susceptible to damage during transport and display handling and in view of their strength and resistance to damage it is possible to package these shades in direct nesting contact without requiring spacers for protection in view of the elimination of the metal framing rings and vertical wire members. This, of course, minimizes packaging time and cost and enables more compact packaging.

These advantages are achieved by the present invention which relates to a lamp shade comprising a hollow seamless shell or foundation molded from plastic material and having at least one opening and having means secured thereto for supporting the shade with respect to a light bulb or lamp fixture, the shell having an inwardly projecting collar molded integrally therewith and which extends around the interior of the opening and to which the shade support means is secured.

In preferred construction, the shell is provided with upper and lower openings with the skirt or collar being provided interiorly of the upper opening.

Also in preferred construction, the shade support means is in the form of a metal lamp shade spider having a circular central ring with outwardly extending arms and of the type adapted for use with a lamp harp or in supporting contact with a lamp socket. The outer ends of the arms of the spider are positioned adjacent holes provided in the collar of the shell and are secured to the collar by headed fasteners having hollow shanks passing through the holes and which receive the ends of the arms.

In a further embodiment, the inner surface of the collar is provided with integrally molded raised threads to threadedly receive a ring molded of plastic material and to which is secured the shade support means which is preferably in the form of a metal lamp shade spider or bulb clip.

A further embodiment of the invention relates to a method of providing the outer surface of a lamp shade of the present or known types with a decorative covering and which method comprises winding and securing thereon yarn or like strand and filamentary material with the material of adjacent windings being in contacting relationship.

BRIEF DESCRIPTION OF THE DRAWINGS

The inventive concepts and various embodiments thereof will now be described in more detail with reference to the accompanying drawings wherein.

DETAILED DESCRIPTION OF DRAWINGS

Figure 1:
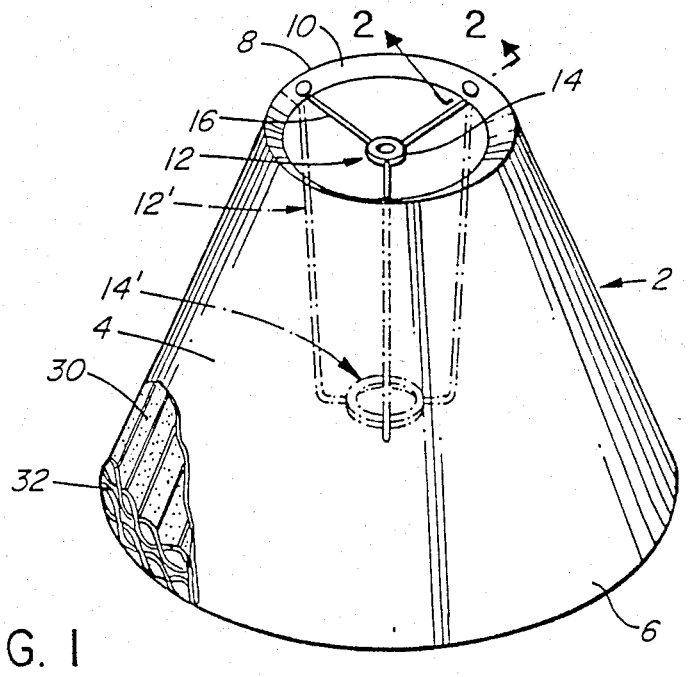
FIG. 1 illustrates in perspective view one embodiment of a lamp shade shell or foundation in accordance with the present invention.

The accompanying drawings will now be described in detail wherein like reference numerals refer to like parts.

Figure 2:
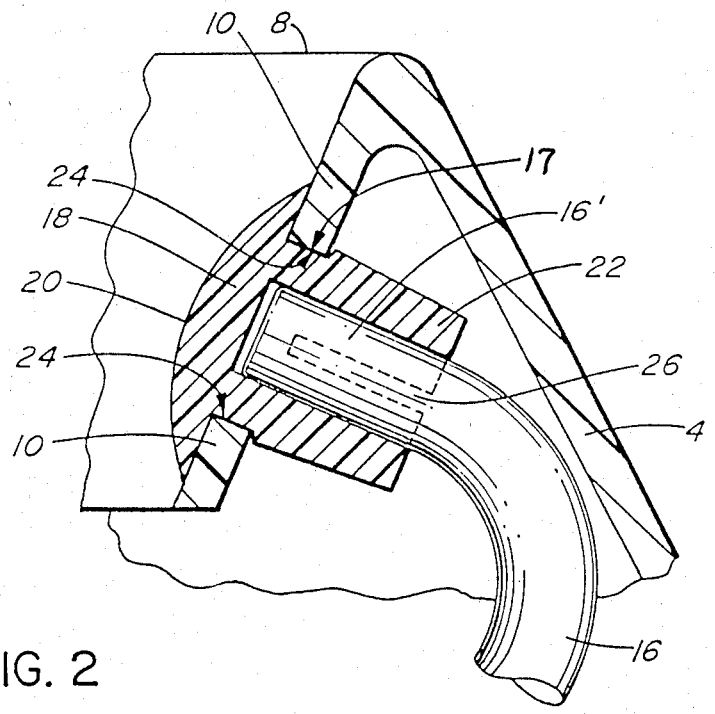
FIG. 2 is a sectional view taken along line 2—2 of FIG. 1.

With reference to FIG. 1, the present shell or foundation shown generally at 2 consists of outer shell surface 4 having a lower edge 6 and a top edge 8 which is shown in section in FIG. 2.

The top edge 8 of shell 2 is integrally provided with an inwardly projecting collar or skirt 10. As clearly shown in FIG. 2, the lower portion of the collar is spaced inwardly from the outer shell portion 4. It is to this collar that a metal spider 12 having a central ring 14 and outwardly extending arms 16 is secured. The collar 10 is provided with three uniformly positioned holes 17 (see also FIG. 2) which are of a size larger than the adjacently positioned outer inwardly pointing ends 16' of the arms 16 of the spider 12 as clearly shown in FIG. 2.

The arm ends 16' are secured to the collar 10 by fasteners or buttons 18 which have smoothly rounded heads 20 and projecting hollow shanks 22 to snugly receive the ends 16' of the arms of the spider. The shanks of the fasteners are preferably provided with undercut portions 24 adjacent the heads, and opposite sides of the shank are provided with slits 26 which enable a snap fit of a fastener within a hole and enable some outward expansion of the shank sides to enable the ends of the arms of the spider to be tightly received therein as shown in FIG. 2. The positioning of the arm ends 16' within the fasteners results in unobtrusive secured positioning of the spider 12 with respect to the shell, and as this securement is spaced inwardly from the outer shell surface, the formation of shadows when an enclosed light bulb is illuminated is avoided.

The foundation or shell 2 can be of any desired shape, and while the drawings show the shell as having a conventional frusto-conical shape, it will be appreciated that other shapes such as cylindrical, spherical, ellipsoidal or other configurations are within the scope of the invention, the only requirement being that the shell have at least one opening with an integrally molded inner collar or skirt 10 to which the shade support means are secured. Moreover, and while the drawings show the opening(s) as being circular, other shapes such as oval and other curving configurations, and square or polygonal are within the inventive concept.

FIG. 1 shows the spider 12 as having three arms 16 which is conventional. It will be appreciated, however, that the spider could have two, or four, or more, arms as desired with the collar being provided with a similar number of holes.

Figure 5:
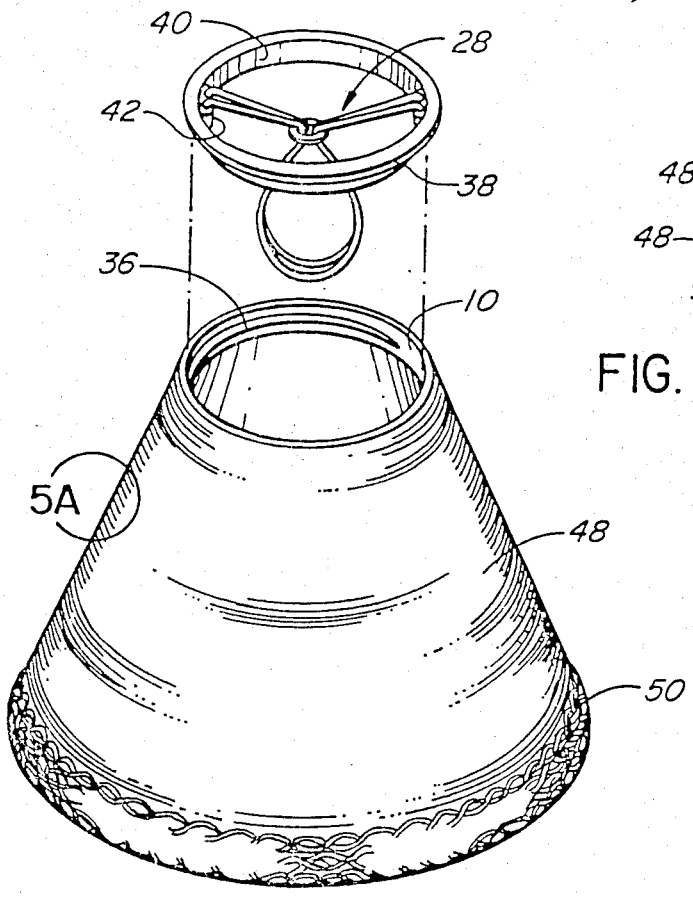
FIG. 5 is a perspective view of a further embodiment of the present invention illustrating means for securement of a light bulb clip or clamp to a molded lamp shade shell.

The spider 12 shown in full lines in FIG. 1 is of the type for use with a conventional lamp harp. A somewhat different shade support is shown in broken lines at 12' which has a lower ring 14' and is adapted (in more European fashion) to be supported on a lamp socket (not shown). These types of spiders and similar supports can be used with the present shell as can a conventional bulb clip or clamp arrangement 28 such as shown in FIG. 5.

The shell or foundation shown at 2 in FIG. 1 can be made of suitable plastic material such as high-impact styrene and be either opaque or transluscent, and of various colorations and used in this form as a finished shade. Preferably, however, the shade will be covered with fabric or similar covering such as partially shown at 30 in FIG. 1 for enhanced appearance.

High-impact styrene is adhesive-receptive and the covering 30 and trim 32 can be secured to the shell using adhesives or other suitable securement means.

Figure 3:
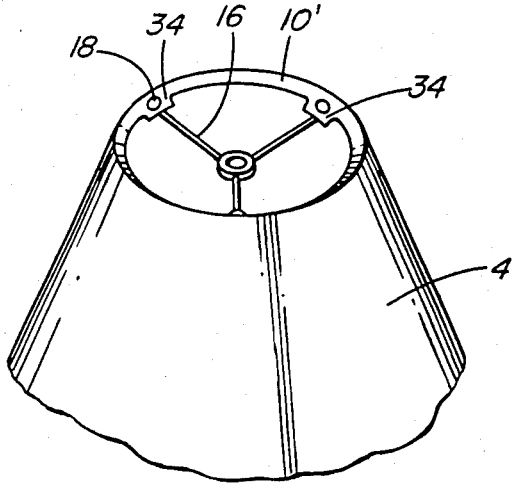
FIG. 3 is a partial view similar to that of FIG. 1 but illustrating a modified inner collar or skirt or flange.

FIG. 3 illustraes a shell similar to that shown in FIG. 1, but showing a modified interior collar 10'. This embodiment shows that the collar need not be of constant height therearound but need simply be formed with downwardly depending tabs 34 having holes for the securement of the ends of the spider arms by fasteners 18.

Figure 4:
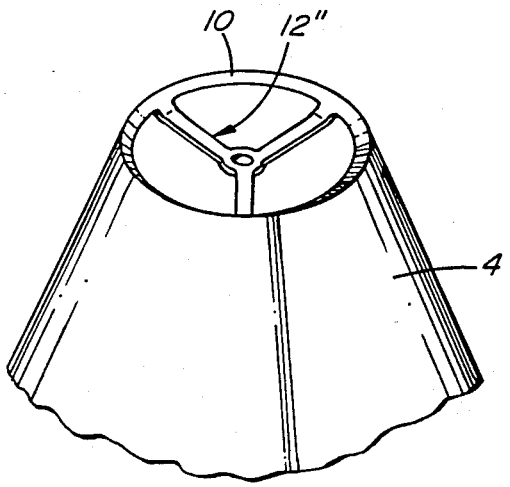
FIG. 4 is a perspective view of a further embodiment of the invention illustrating shade support means in the form of a spider molded of plastic material integrally with the shell.

FIG. 4 illustrates a shell similar to that shown in FIG. 3, and wherein a lamp spider 12" of plastic material is formed integrally with the collar during molding. Plastic spiders can be used when they are of a type adapted for use with a lamp harp or in contact with a lamp socket, but plastic spiders should be avoided when they would be in direct contact with a light bulb itself and of the type as shown at 28 in FIG. 5.

A further embodiment of the present invention is illustrated in FIG. 5. In this drawing, the collar 10 is provided with molded threads 36 to threadingly receive threads 38 molded on ring 40 which is molded of synthetic thermoplastic material such as high heat polypropylene. The ring 40 is provided with inwardly extending tabs or projections 42 provided with holes (not numbered) to receive the downwardly projecting outer ends (not numbered) of the ends of the arms of the light bulb clip or clamp 28 which is formed of wire.

Figure 6:
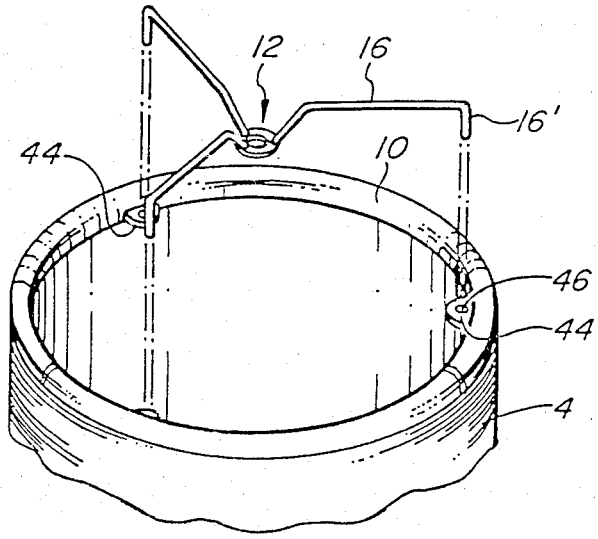
FIG. 6 illustrates further means for securing a metal lamp shade spider to a molded shell according to the present invention.

While FIG. 5 specifically shows a light bulb clip or clamp, it will be appreciated that spiders of the types shown in FIGS. 1 and 6 could also be used and secured in the same fashion as in FIG. 5. The clip arrangement 28 as shown in FIG. 5 will primarily be used with shades of smaller size.

An alternative method of securing a bulb clip 28 or spider 12 to the lamp shade shell is illustrated in FIG. 6. In this embodiment, the interior collar 10 is provided with inwardly directed tabs 44 provided with holes 46 for the reception and securement of the downwardly projecting ends 16' of the spider arms 16 in the fashion as shown. The ends of the spider arms could be of a size to be tightly received within the holes in the tabs 44, or alternatively, the ends of the arms could be crimped or bent after passing through the tabs to provide positive securement.

Figure 5A:
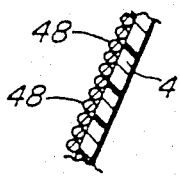
FIG. 5A is an enlarged cross-sectional view of the area encircled in FIG. 5.

The present invention also contemplates a novel method of providing a final outer covering on the shell by winding thread, yarn or other strand or filamentary material 48 around the shell to cover the outer surface of the shell in the manner as shown in FIG. 5, and in sectional view in FIG. 5A. Beginning at one end of the shell, preferably the smaller end if the shell is conical, the thread or yarn is wound around the shell in continuous fashion so that the adjacent windings are in contacting relationship with each other to completely cover the outer surface of the shell. The wound strands or filaments are secured, at least at their ends, to the shell and this may be done by any suitable means such as for example by adhesives.

As shown in FIG. 5, and after the winding of the yarn, upper and lower trim 50 can be provided to enhance the appearance of the shade. Only lower trim is shown in FIG. 5.

The advantages of finishing a shade using yarn or similar windings are many, and shades of various colorations and texture (depending upon the strand or filamentary material used) are possible to provide shades for all room decors and for use in a particular room.

Conventionally, shades are covered using fabric or similar materials and a substantial inventory of such materials must be kept on hand for such purpose. The cost of these materials is high, and due to continuously changing customer preference with regard to coloration, texture, and the like, a constant expensive supply of suitable fabrics is necessary to satisfy requirements. Spools of yarn, however, may be stocked at minimum cost and as yarns of all possible configuration and texture are available, it is convenient for a manufacturer to be able to quickly produce covered shades of different colorations and texture to meet changing consumer demands and to provide the consumer with a great selection of shades of various colors and textures.

Moreover, the covering of lamp shades with fabric material (particularly fabrics with patterns which must be matched) results in much material wastage and which wastage is completely avoided in the manufacture of a shade covered with wound yarn in the manner as shown in FIG. 5. Moreover, a wound yarn covered shade has no seams which are often present in shades covered with fabric or like material.

The yarn, thread, rope or similar strand or filamentary material used for the winding may be of suitable natural and synthetic material in monofilament, twisted, woven, plaited or stranded form, and for example, may be of wool, cotton, fiberglass, metal or similar.

The embodiments of the invention in which an exclusive property or privilege is claimed are defined as follows:

1. A lamp shade comprising a hollow seamless shell or foundation molded from plastic material and having upper and lower openings and having support means removably secured thereto for supporting the shade with respect to a light bulb or lamp fixture, the upper opening having an inwardly projecting collar molded integrally therewith and extending therearound, and at least two holes provided in the collar;

the shade support means having outwardly extending arms which are secured in respective holes in the collar by fastening means.

2. A lamp shade according to claim 1, wherein the support means is a metal lamp spider having a center ring with outwardly extending arms, the outer ends of the arms being secured in respective holes provided in the collar and secured therein by said fastening means which are headed fasteners having hollow shanks which pass through the holes, the ends of the arms being secured within the hollow shanks of respective fasteners.

3. A shade according to claim 2, wherein the heads of the fasteners are smoothly rounded.

4. A shade according to claim 2, wherein the shank of each fastener is provided with an undercut portion of reduced section adjacent the head of the fastener and which is of a size approximating the size of the holes provided in the collar, the hollow shank of each fastener having opposed longitudinal slits to facilitate positioning of the fastener in a hole and reception of the end of an outwardly extending arm.

5. A shade according to claim 2, wherein downwardly projecting tabs are molded integrally with the collar, the holes for reception of the fasteners being formed in the tabs.

6. A shade according to claim 1, wherein inwardly directed projections having holes therein are molded integrally with the collar, the shade support means being a metal lamp spider or bulb clip with outwardly extending arms the ends of which are received in the holes in the projections and secured therein by said fastening means.

7. A shade according to claim 1, wherein the inner surface of the collar is provided with raised integrally molded threads to threadedly receive a ring molded of plastic material, the ring being formed with inwardly projecting integrally molded tabs having at least two holes therein, the shade support means being a metal lamp spider or bulb clip having outwardly extending arms the outer ends of which are secured in the respective holes in the tabs.

8. A shade according to claim 1, wherein at least the outer surface of the shell is covered with a fabric or like decorative material.

9. A shade according to claim 1, wherein the outer surface of the shell is provided with a covering consisting of yarn or like strand or filamentary material wound on the surface with material of adjacent windings being in contacting relationship.

10. A shade according to claim 9, wherein the wound strand or filamentary material is secured to the shell by adhesive.

11. A shade according to claim 9, having decorative trim strips provided on the outer surface of the shell around the upper and lower openings.

* * * * *